United States Patent [19]

Wilson

[11] 4,205,475

[45] Jun. 3, 1980

[54] PROJECTILE LUBRICANT SHIELD AND PERCUSSION CAP HOLDER

[76] Inventor: Hugh R. Wilson, 10840 SW. 120th St., Miami, Fla. 33176

[21] Appl. No.: 933,450

[22] Filed: Aug. 14, 1978

[51] Int. Cl.[2] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 243,250 | 6/1881 | Hall | 42/90 |
| 4,050,175 | 9/1977 | Mulinix | 42/90 |
| 4,094,098 | 6/1978 | Gourley | 42/90 |
| 4,112,606 | 9/1978 | Griffin | 42/90 |
| 4,135,322 | 1/1979 | Tice et al. | 42/90 |

*Primary Examiner*—Charles T. Jordan

[57] ABSTRACT

The invention is that of a tubular shield for protecting the lubricant on a pre-lubricated projectile from contamination and loss of lubricant while the projectile is held ready for use in a muzzle-loading firearm. The pre-lubricated projectile is inserted into the shield device, the walls of which fit tightly against the surface of the projectile, and the lubricant which is in the grooves of the projectile is sealed in preventing migration of the lubricant. The projectile is pushed directly from the shield into the bore of a firearm by use of a ramrod which is inserted into one end of the shield. A split socket for holding a fresh percussion cap is mounted on the shield for quick use after the firearm has been charged with powder and the projectile has been seated in the bore of the barrel.

1 Claim, 5 Drawing Figures

PROJECTILE LUBRICANT SHIELD AND PERCUSSION CAP HOLDER

FIELD OF THE INVENTION

The device is intended for use with muzzle-loading guns for hunting and for target shooting.

DESCRIPTION OF THE PRIOR ART

Before the turn of the century when muzzle-loading arms were widely used, the arms were loaded with a round ball and a greased cloth patch. Although the hand of the user was soiled a bit when loading the ball and patch, soiling was reduced by storing the greased patches in a patch box which was inlaid into the butt stock of the rifle. The solid base conical projectile in use today presents a few serious problems insofar as cleanliness is concerned. For optimum accuracy, it is best to use a very soft lubricant which is composed chiefly of vegetable shortening. If such a projectile generously coated with such a soft lubricant were carried in a pocket or pouch, the walls of the pocket or pouch would be well covered with the lubricant but very little would remain on the projectile where it is needed and needless to say, the user's hand would be very well greased. These problems are eliminated with this device as the lubricant is sealed in with the projectile and is carried into the bore of the firearm when the projectile is introduced into the barrel of the firearm. Although a few devices have appeared in the past that contained a projectile, they also contained a powder charge as well. This presents a storage problem as in the case of a fire, such a powder charge of black powder could cause an explosion hazard and also present a problem if such a loaded container fell into the hands of small children. With this device, there is no powder present. This device does however have provision for holding a fresh percussion cap ready for instant use. The novelty and usefulness of this device is readilty apparent and the distinct difference in both structure and function in it's construction serves to separate it from the prior art.

SUMMARY OF THE INVENTION

It is an object of this invention to provide a new and novel projectile lubricant shield and cap holder that is quick, easy and clean to use.

Another object of this invention is to provide a new and novel lubricant shield and cap holder that is cheap to produce and which will result in economical enjoyment of the sport of blackpowder shooting by many people.

Figure 1:
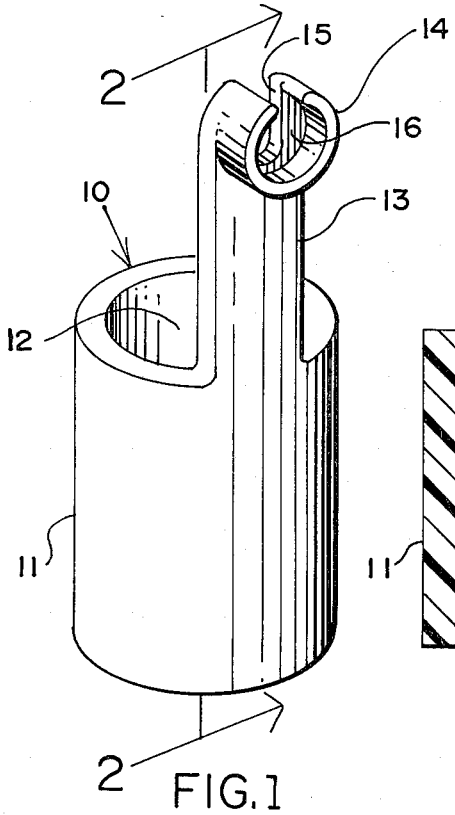
FIG. 1 shows the device in an empty state.
Figure 2:
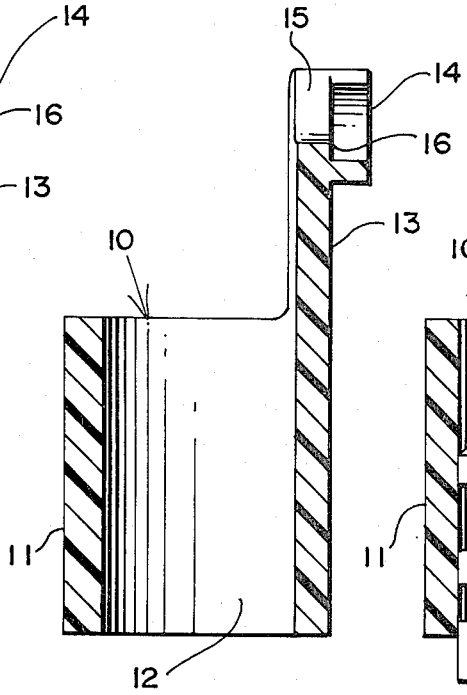
FIG. 2 is a sectional view of the device in an empty state.
Figure 3:
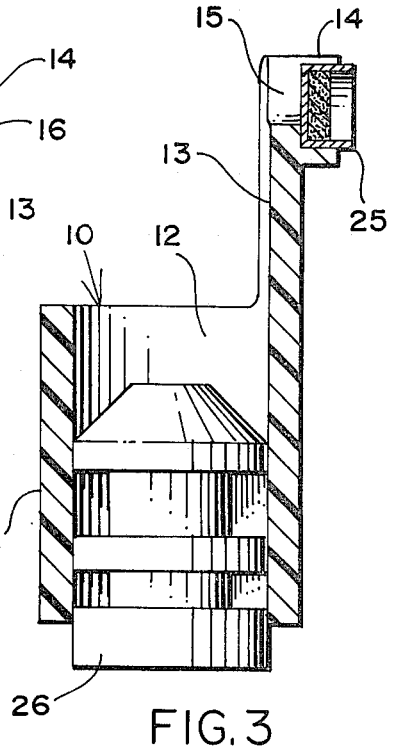
FIG. 3 is a sectional view of the device with a projectile and a percussion cap held in place.
Figure 4:
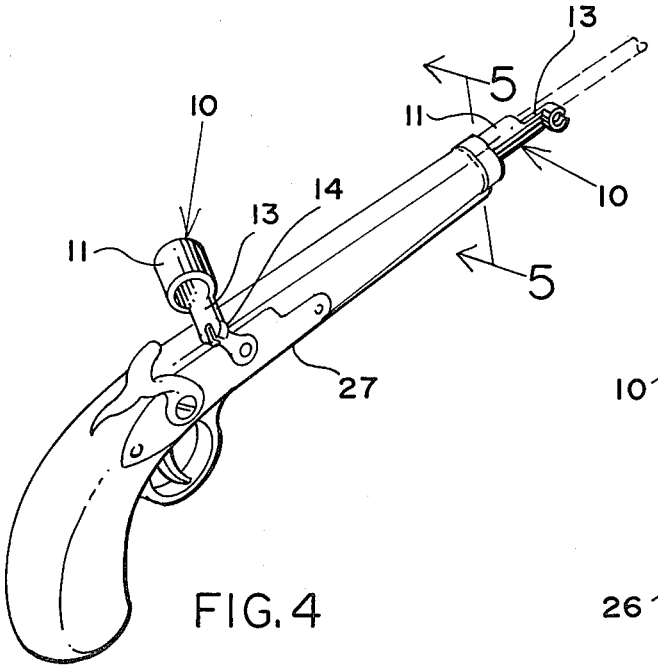
FIG. 4 shows a firearm with the device in a position for attaching a percussion cap to a breech nipple.
Figure 5:
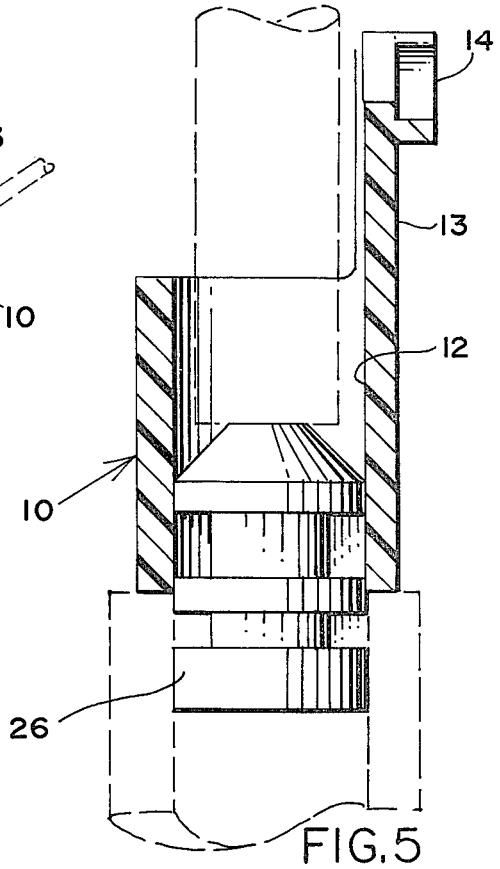
FIG. 5 shows the device as placed on the muzzle end of a gun barrel with the projectile being pushed into the bore of a firearm by a ramrod. The ramrod and the barrel are shown by broken lines.

DESCRIPTION OF THE PREFERRED EMBODIMENT:

Referring to the drawings by characters of reference, FIGS. 1–5 illustrate a projectile lubricant shield and cap holder 10.

The body 11 is in the form of a tube which is open at both ends. A pre-lubricated projectile 26 is forced into one end of the body 11 and is held tightly in place by the inner wall 12 which is of a size to assure a tight fit for the projectile 26. The bottom end of the projectile 26 is allowed to protrude slightly from the body 11. The neck 13 is a part of the body 11 and provides a base for the cap retaining socket 14 which is for holding the percussion cap 25. A percussion cap 25 is placed in the socket 14 and against the rear wall 16 of the socket 14. The slot 15 is provided to allow the socket 14 to deflect around the percussion cap 25 when the percussion cap 25 is placed on a breech nipple of a firearm 27.

OPERATION OF THE DEVICE:

To use the device, a projectile is completely coated with a proper lubricant making sure that the grooves in the projectile are completely filled with lubricant. The projectile is then placed base down on a flat surface and the shield is pushed down over the projectile. The device, being made of a yieldable material will stretch tightly over the projectile pushing all excess lubricant aside. The device and the base of the projectile are then wiped clean of lubricant and a fresh percussion cap is placed in the retaining socket. To transfer the lubricated projectile into the bore of a firearm, the device is set on the muzzle end of the arm with the slightly projecting base of the projectile entering the bore. A ramrod is then inserted into the top end of the device and the projectile is pushed from the device and into the bore of the arm. The percussion cap is attached to the breech nipple by holding the device in the hand with the forefinger on the back side of the cap socket. The cap is pushed onto the nipple with the forefinger and the device is pulled away leaving the percussion cap on the breech nipple.

The device is re-usable and may be re-filled for future use.

Although but a few embodiments of the invention have been shown and described, it will be apparent to those skilled in the art that various changes and modifications may be made therein without departing from the spirit of the invention or from the scope of the appended claims.

What is claimed is:

1. A projectile lubricant shield and percussion cap holder comprising:

tube means for releaseably encasing a lubricant coated projectile, said tube means being of a yieldable material and open at both ends, retaining means mounted on said tube means for releaseably holding a percussion cap, said retaining means having a cavity for receiving and holding a percussion cap, said cavity having open slot means in its wall, said slot means allowing said cavity to release said percussion cap when said percussion cap is placed upon the cap nipple of a firearm and said retaining means is pulled away from said nipple in a right angle direction.

* * * * *